US011866953B2

(12) United States Patent
Wood

(10) Patent No.: US 11,866,953 B2
(45) Date of Patent: Jan. 9, 2024

(54) POST SUPPORT HAVING EXTENSIVE ANGULAR ADJUSTABILITY

(71) Applicant: ORIGIN POINT BRANDS, LLC, Summerville, SC (US)

(72) Inventor: John Wood, Mt. Pleasant, SC (US)

(73) Assignee: ORIGIN POINT BRANDS, LLC, Summerville, SC (US)

( * ) Notice: Subject to any disclaimer, the term of this patent is extended or adjusted under 35 U.S.C. 154(b) by 0 days.

(21) Appl. No.: 17/255,521

(22) PCT Filed: Jun. 26, 2019

(86) PCT No.: PCT/US2019/039237
§ 371 (c)(1),
(2) Date: Dec. 23, 2020

(87) PCT Pub. No.: WO2020/009867
PCT Pub. Date: Jan. 9, 2020

(65) Prior Publication Data

US 2021/0285253 A1 Sep. 16, 2021

Related U.S. Application Data

(60) Provisional application No. 62/692,998, filed on Jul. 2, 2018.

(51) Int. Cl.
*E04H 12/22* (2006.01)

(52) U.S. Cl.
CPC ..... *E04H 12/2284* (2013.01); *E04H 12/2215* (2013.01)

(58) Field of Classification Search
CPC ..... E04H 17/22; E04H 12/22; E04H 12/2215; E04H 12/223; E04H 12/2253; E04H 12/2269; E04H 12/2284
See application file for complete search history.

(56) References Cited

U.S. PATENT DOCUMENTS 3,021,638 A 2/1962 Kristek
3,414,908 A * 12/1968 Dadson ..... A61F 2/76 403/81

(Continued)

FOREIGN PATENT DOCUMENTS

EP 2647766 A2 10/2013
GB 2512316 A * 10/2014 ..... E04H 12/2215
JP 9191991 7/1997

OTHER PUBLICATIONS

International Search Report re PCT/US19/39237 dated Sep. 16, 2019.

*Primary Examiner* — Jonathan Liu
*Assistant Examiner* — Guang H Guan
(74) *Attorney, Agent, or Firm* — Parker Poe Adams & Bernstein, LLP; Timothy D. St. Clair

(57) ABSTRACT

An adjustable post support includes a post receptacle with a first longitudinal axis; a mount with a second longitudinal axis; and upper and lower adjustment plates disposed therebetween. The upper adjustment plate resides closer to the receptacle, rotates about the first longitudinal axis, and has a first surface above an opposing second surface. The first surface remains normal to the first longitudinal axis when rotated. The second surface resides at an angle to the first surface. The lower adjustment plate rotates about the second longitudinal axis and has a third surface above an opposing fourth surface. The fourth surface remains normal to the second longitudinal axis when rotated. The third surface resides at an angle to the fourth surface. The second surface is disposed against the third surface.

14 Claims, 14 Drawing Sheets

(56) References Cited

U.S. PATENT DOCUMENTS

| | | | | | |
|---|---|---|---|---|---|
| 4,809,421 | A | | 7/1989 | Justice | |
| 5,458,428 | A | * | 10/1995 | West | E04C 3/30 403/252 |
| 5,884,874 | A | * | 3/1999 | Speece | E04H 12/2215 52/165 |
| 5,927,677 | A | | 7/1999 | Speece | |
| 6,273,390 | B1 | | 8/2001 | Meyer | |
| 7,219,872 | B2 | * | 5/2007 | Walker | E04H 12/2215 248/516 |
| D579,585 | S | * | 10/2008 | Walker | E04H 17/22 D25/131 |
| 8,011,149 | B2 | * | 9/2011 | Knudsen | E04B 1/92 52/165 |
| 8,322,678 | B2 | * | 12/2012 | Zhu | E04H 12/2215 248/516 |
| 8,523,134 | B2 | * | 9/2013 | Walker | E04H 17/22 248/156 |
| 10,378,232 | B2 | * | 8/2019 | Volin | E04H 12/2261 |
| 2010/0186314 | A1 | | 7/2010 | Walker | |
| 2015/0259943 | A1 | | 9/2015 | Paananen | |
| 2021/0285253 | A1 | * | 9/2021 | Wood | E04H 12/2215 |

* cited by examiner

POST SUPPORT HAVING EXTENSIVE ANGULAR ADJUSTABILITY

CROSS REFERENCE TO RELATED APPLICATIONS

This application claims the benefit of priority of U.S. Provisional Application Ser. No. 62/692,998, filed on Jul. 2, 2018, which is incorporated herein in its entirety.

STATEMENT REGARDING FEDERALLY SPONSORED RESEARCH OR DEVELOPMENT

Not applicable.

THE NAMES OF PARTIES TO A JOINT RESEARCH AGREEMENT

Not applicable.

INCORPORATION-BY-REFERENCE OF MATERIALS SUBMITTED ON A COMPACT DISC OR AS A TEXT FILE VIA THE OFFICE ELECTRONIC FILING SYSTEM

Not applicable.

STATEMENT REGARDING PRIOR DISCLOSURES BY THE INVENTOR OR A JOINT INVENTOR

Not applicable.

BACKGROUND OF THE INVENTION

Field of the Invention

The present invention relates to a post support and, more particularly, to a post support that provides for extensive adjustment of the angle of the post thereby installed relative to the mount of the post support.

Description of the Related Art

Posts are used in many contexts. Fence posts, sign posts, mailbox posts, garden posts, deck posts, and birdfeeder posts are but a few examples of the many common uses of posts.

In many instances, it is desirable that the longitudinal axis of a post, once secured in a desired location, be vertical relative to the horizon. Achieving such verticality is not always easy, however. For posts mounted in a hole dug in the ground, for example, care must be taken to retain verticality while the post hole is refilled with soil around an installed post or while concrete is poured into, and cures within, a post hole around an installed post.

For posts that are to be mounted to a post support that has been driven into the ground, care must be taken to insure that the post support is driven perpendicularly into the ground. Such post mounts offer convenience, as no hole first must be dug into the ground, but experience has shown that it can be difficult to insure that the post mount is, indeed, driven perpendicularly into the ground. Furthermore, should such a post mount be deflected by an underground rock or tree root while being forced into the ground, the orientation of the post mount can be deflected, thereby defeating the verticality of the post later installed in such a post mount.

For posts mounted to another preexisting structure, such as a deck, care must be taken to retain verticality while the post or post support is screwed, bolted, or otherwise connected to the preexisting structure. If the preexisting structure itself is not plumb, additional accommodation must be made so that the post, once installed, is vertical to the horizon but not necessarily perpendicular, for example, to the preexisting, nonplumb structure.

Existing devices have attempted to allow post installers to adjust the angle of the installed post relative to its mount so as to provide for verticality of the installed post. For example, ball-and-socket connections between the support mount and the support's post receptacle have been provided, which allow for certain of such adjustment. But the existing adjustable post supports have been found to be cumbersome to adjust, unstable in application, expensive to manufacture, and complicated to use.

In view of the foregoing, it would be desirable to have a simplified, easy to use, less expensive, and more versatile adjustable post support that would allow posts to be installed and easily adjusted to a vertical orientation.

The present invention relates to an improvement upon the known systems and methods of adjustable post supports, and provides distinct advantages over the conventional systems and methods.

BRIEF SUMMARY OF THE INVENTION

An adjustable post support that has been optimized for use in mounting vertical posts is provided. As revealed in the following description and the figures herein, this invention discovers a simplified, easy to use, less expensive, and more versatile adjustable post support design.

In accordance with certain aspects of certain embodiments of the present technology, an adjustable post support is provided. The adjustable post support includes a post receptacle, a mount, and upper and lower adjustment plates disposed between the post receptacle and the mount.

The upper adjustment plate may be rotated about an axis, in some instances the longitudinal axis of the receptacle. The upper adjustment plate has a first surface and a second surface, the first surface being above the second surface and closer to the receptacle. The first surface may be at least partially planar and the at least partial plane of the first surface may remain normal to the longitudinal axis of the receptacle as the upper adjustment plate is rotated about the longitudinal axis of the receptacle. The second surface may be at least partially planar, the at least partial plane of the second surface not parallel with the at least partial plane of the first surface.

The lower adjustment plate may be rotated about an axis, in some instances the longitudinal axis of the mount. The lower adjustment plate has a third surface and a fourth surface, the fourth surface being below the third surface and closer to the mount. The fourth surface may be at least partially planar and the at least partial plane of the fourth surface may remain normal to the longitudinal axis of the mount as the lower adjustment plate is rotated about the longitudinal axis of the mount. The third surface may be at least partially planar, the at least partial plane of the third surface not parallel with the at least partial plane of the fourth surface.

The second surface of the upper adjustment plate may bear against the third surface of the lower adjustment plate.

Thus, the upper and lower adjustment plates may be rotated relative to one another such that the longitudinal axis of the receptacle and the longitudinal axis of the mount are parallel. Additionally, however, the upper adjustment plate may be rotated relative to the receptacle, and/or the lower adjustment plate may be rotated relative to the mount, and/or the upper and lower adjustment plates may be further rotated relative to one another, such that the longitudinal axis of the receptacle is caused to reside at an angle, for example angle C, that is not one hundred eighty degrees relative to the longitudinal axis of the mount. Considering that the upper adjustment plate may be rotated at any of three hundred sixty different degrees of orientation relative to the lower adjustment plate, and that the lower adjustment plate may be rotated at any of three hundred sixty different degrees or orientation relative to the mount, angle C might be any of thousands of different orientations.

In accordance with additional aspects of other embodiments of the present technology, an adjustable post support is provided that includes a post receptacle. The post receptacle may define a longitudinal axis and may be configured for engagement with a fence post with the fence post residing at least partially along the longitudinal axis. Upper and lower adjustment plates may reside below the receptacle. The upper adjustment plate may reside above the lower adjustment plate and closer to the receptacle. The upper adjustment plate may be rotatable about the longitudinal axis. The upper adjustment plate may have a first surface and an opposing second surface, the first surface being above the second surface and disposed closer to the receptacle. The second surface may be at least partially planar, the at least partial plane of the second surface residing at an acute angle to and not orthogonal to the first longitudinal axis. The lower adjustment plate may define a rotational axis and may be rotatable about the rotational axis. The lower adjustment plate may have a third surface and an opposing fourth surface, the third surface being above the fourth surface and disposed closer to the upper adjustment plate. The third surface may be at least partially planar, the at least partial plane of the third surface residing at an acute angle to and not orthogonal to the rotational axis. The at least partial plane of the second surface may abut the at least partial plane of the third surface. In particular embodiments, a mount may be included. In certain configurations, the mount may be a stake. The post receptacle may be male, or it may be female. Selective illustration may provide the upper adjustment plate with a tab residing outboard of the upper adjustment plate. Additional examples include the upper adjustment plate and the lower adjustment plate being round. A method of adjusting the angular orientation of a post relative to the horizon may include the steps of providing an adjustable post support of one of the foregoing embodiments, mounting the adjustable post support, rotating one or both of the upper adjustment plate and the lower adjustment plate until the desired angular orientation of the receptacle is achieved, and installing a post in the receptacle.

In accordance with additional aspects of other embodiments of the present technology, an adjustable post support is provided with a post receptacle, a mount, and upper and lower adjustment plates. The post receptacle may define a first longitudinal axis and the mount may define a second longitudinal axis. The upper and lower adjustment plates may be disposed between the post receptacle and the mount, the upper adjustment plate residing above the lower adjustment plate and closer to the receptacle. The upper adjustment plate may be rotatable about the first longitudinal axis. The upper adjustment plate may have a first surface and an opposing second surface, the first surface being above the second surface and disposed closer to the receptacle. The first surface may be at least partially planar and the at least partial plane of the first surface may remain perpendicular to the first longitudinal axis as the upper adjustment plate is rotated about the first longitudinal axis. The second surface may be at least partially planar, the at least partial plane of the second surface residing at an angle to and not parallel with the at least partial plane of the first surface. The lower adjustment plate may be rotatable about the second longitudinal axis. The lower adjustment plate may have a third surface and an opposing fourth surface, the fourth surface being below the third surface and disposed closer to the mount. The fourth surface may be at least partially planar and the at least partial plane of the fourth surface may remain perpendicular to the second longitudinal axis as the lower adjustment plate is rotated about the second longitudinal axis. The third surface may be at least partially planar, the at least partial plane of the third surface residing at an angle to and not parallel with the at least partial plane of the fourth surface. The second surface disposed against the third surface. The post receptacle may be either male or female. In particular embodiments, the upper adjustment plate may further include a tab residing outboard of the upper adjustment plate. In certain configurations, the upper adjustment plate and the lower adjustment plate are round. A method of adjusting the angular orientation of a post relative to the horizon may include the steps of providing an adjustable post support of one of the foregoing embodiments, mounting the adjustable post support, rotating one or both of the upper adjustment plate and the lower adjustment plate until the desired angular orientation of the receptacle is achieved, and installing a post in the receptacle.

In accordance with yet still further aspects of other embodiments of the present technology, an adjustable post support is provided with a post receptacle, the post receptacle defining a first longitudinal axis. A mount is included, the mount defining a second longitudinal axis. Means are provided for adjusting the angular orientation of the first longitudinal axis relative to the second longitudinal axis. In some configurations, the post receptacle is male, whereas in others the post receptacle is female. Specific representations provide the means with outboard tabs. The means are round in selective illustrations. A method of adjusting the angular orientation of a post relative to the horizon may include the steps of providing an adjustable post support of one of the foregoing embodiments, mounting the adjustable post support, rotating the means until the desired angular orientation is achieved, and installing a post in the receptacle.

The foregoing description sets forth broadly certain features of the present invention so that the detailed description herein below may be better understood, and so that the present contributions to the art from this invention may be better appreciated.

Other advantages of the present invention will become apparent from the following descriptions, taken in connection with the accompanying drawings, wherein, by way of illustration and example, an embodiment of the present invention is disclosed.

BRIEF DESCRIPTION OF THE SEVERAL VIEWS OF THE DRAWINGS

The details of the present invention, both as to its structure and operation, can be understood in reference to the detailed description below in combination with the drawings, in which.

Figure 1:
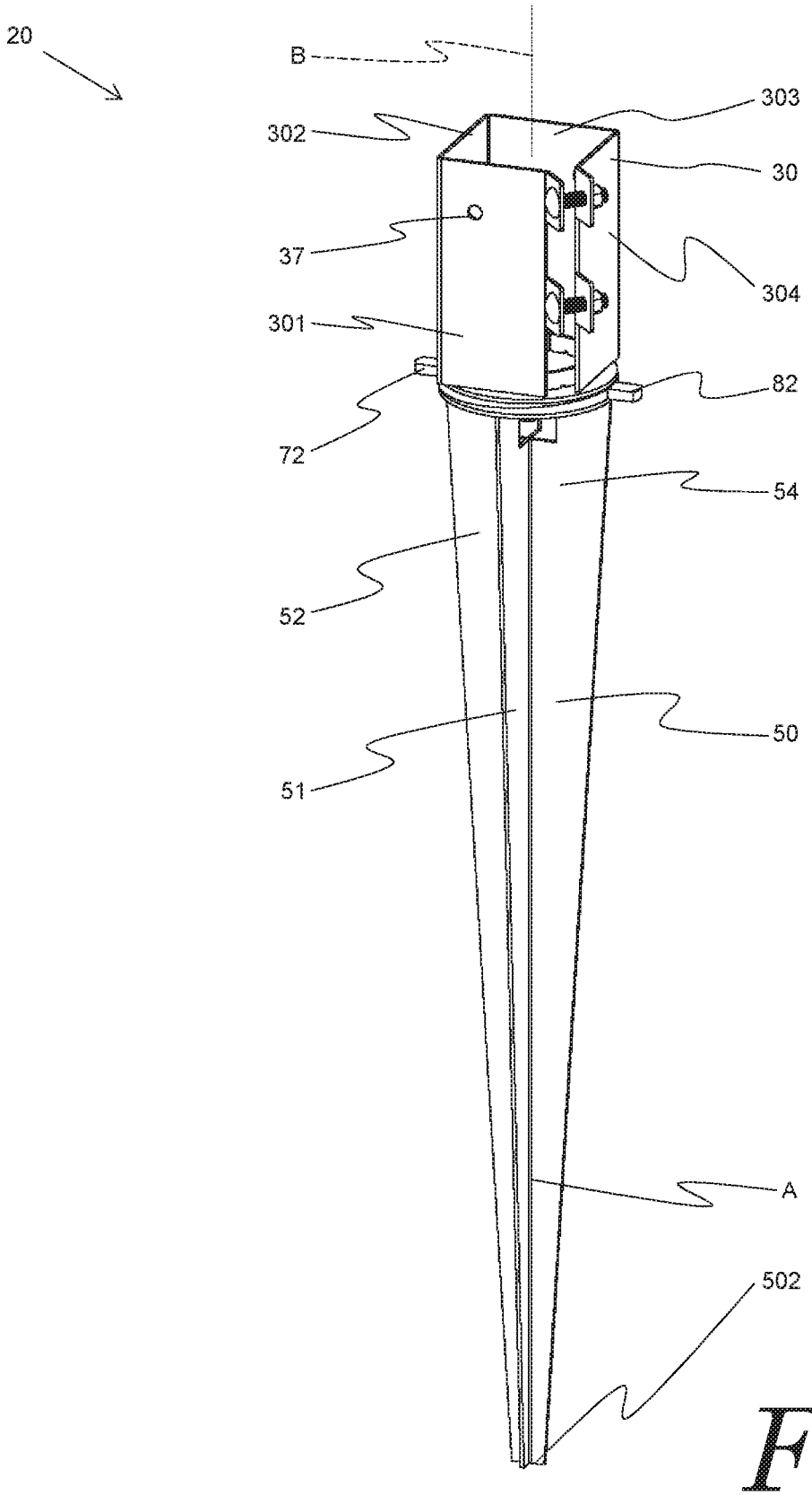
FIG. 1 is a perspective view of an adjustable post support in accordance with an embodiment of the present invention, wherein the longitudinal axis of the receptacle and the longitudinal axis of the mount are parallel.

It should be noted that the drawings discussed above and below are not to scale in all instances, but may have exaggerated dimensions in some respects to illustrate one or more of the principles of the invention.

DETAILED DESCRIPTION OF THE INVENTION

Reference will now be made in detail to the presently preferred embodiments of the invention, one or more examples of which are illustrated in the drawings. Each example is provided by way of explanation of the invention, and is not meant as a limitation of the invention. For example, features illustrated or described as part of one embodiment may be used with a second embodiment to yield a third embodiment. It is intended that the present application include such modifications and variations as come within the scope and spirit of the invention. Repeat use of reference characters throughout the present specification and appended drawings is intended to represent the same or analogous features or elements of the invention.

Before any embodiments of the invention are explained in detail, it is to be understood that the invention is not limited in its application to the details of construction or to the arrangement of components set forth in the following description or illustrated in the following drawings. The invention is capable of other embodiments and of being practiced or of being carried out in various ways. Also, it is to be understood that the phraseology used herein is for the purpose of description and should not be regarded as limiting. The use of formatives of the words "include," "comprise," and "have" is meant to encompass the items listed thereafter and equivalents thereof, as well as additional items. Unless specified or limited otherwise, the term "connected" is used broadly and encompasses direct and indirect mountings, connections, supports, or couplings. Further, such phraseology is not limited to physical or mechanical connections or couplings.

As used herein, the words "above," "upper," "top," and like gravitational orientations denote positions and/or orientations relatively toward the adjustable post mount receptacle and distal from the mount. Similarly, the words "below," "lower," and "bottom" denote positions and/or orientations relatively distal from the adjustable post mount receptacle and relatively toward the mount.

An adjustable post support, generally 20, is provided. Adjustable post support 20 may include a mount, a receptacle, and upper and lower adjustment plates disposed between the receptacle and the mount.

Any and all of the mount, receptacle, and upper and lower adjustment plates may be fabricated, in whole or in part, of metal, of plastic, of resin, of carbon fiber, or of other material, alone or in combination.

An example receptacle 30 is illustrated in the appended figures. Generally, receptacle 30 may be configured to engage with a post. Example receptacle 30 is illustrated in the appended drawings to be of a female configuration, to receive therein a post. Alternatively, however, receptacle 30 may be of a male configuration, so as to be received within an aperture defined within a post, such as for example a post with a hollow that has been configured to receive therein a male receptacle 30, and still be within the scope of the invention herein.

Receptacle 30 in the illustrated embodiment is configured to receive therein a post of rectangular cross-section. However, other female-configured receptacles 30 may be configured to receive posts of round cross-sections or of other advantageous cross-sections as particular circumstances may find beneficial.

In the illustrated embodiment of receptacle 30, a first side 301 is joined with a second side 302. Second side 302 is joined with third side 303, which in turn is joined with fourth side 304. In some embodiments, fourth side 304 may joined with first side 301 but, in the illustrated embodiment, fourth side 304 and first side 301 are not joined. Instead, in the illustrated embodiment, first side 301 includes a first tab 31 projecting therefrom. First tab 31 includes a tab aperture 39*a*. Similarly, fourth side 304 includes a third tab 33 aligned with first tab 31, third tab 33 including a tab aperture 39*c*. A tightener, such as first bolt 351 with a first nut 352, may be disposed through apertures 39*a*, 39*c* to draw first tab 31 and third tab 33 toward one another and thereby more tightly grip a post disposed within receptacle 30. In other optional embodiments, first side 301 may include a second tab 32 projecting therefrom. Second tab 32 may include a tab aperture 39*b*. Similarly, fourth side 304 optionally may include a fourth tab 34 aligned with second tab 32, fourth tab 34 optionally including a tab aperture 39*d*. A tightener, such as a second bolt 361 with a second nut 362, may be disposed through apertures 39*b*, 39*d* to draw second tab 32 and fourth tab 34 toward one another and thereby more tightly grip a post disposed within receptacle 30.

Receptacle 30 may also include a receptacle plate 91 disposed proximate the bottom of receptacle 30. Receptacle plate 91 may include a receptacle plate aperture 94 therethrough, with a tightening bolt 381 and tightening nut 382 residing in receptacle plate aperture 94. Tightening bolt 381 and tightening nut 382 may be used to tighten receptacle 30 to a mount, such as a stake 50, once a desired angular orientation between the mount, such as a stake 50, and receptacle 30 is achieved.

In the embodiment illustrated in the drawings, receptacle 30 is depicted to include one or more apertures 37. Aperture 37 may allow a user the place a screw or bolt through a side 301, 302, 303, and/or 304 once a post has been received in receptacle 30, to further secure the post to receptacle 30.

Receptacle 30 may be understood to have a receptacle axis B. Receptacle axis B is a longitudinal axis of receptacle 30. Receptacle axis B may also be understood and defined to include a longitudinal axis of a post mounted in receptacle 30. In certain embodiments, including the embodiment illustrated in the appended drawings, receptacle axis B is parallel to the planes in which first side 301, second side 302, third side 303, and fourth side 304 reside.

Various mounts may be used with adjustable post support 20. For example, a surface mount may be used for mounting a post to a deck or other nominally horizontal surface. Such a surface mount may include a generally planar lower surface, to abut against the surface upon which the adjustable post support is to be affixed, for example a deck. If a surface mount is used, it may be understood to define a axis A perpendicular to its generally planar lower surface.

Only for illustrative purposes herein, a stake 50 exemplifies a type of mount for adjustable post support 20. Other mounts, including surface mounts as described in the preceding paragraph, are included in the scope of the within invention.

Stake 50 may be understood to have an upper end 501 proximate receptacle 30 and a lower end 502 distal from receptacle 30. Various embodiments of stake 50 may be used with the within adjustable post support 20 and fall within the scope of the within invention; for illustrative purposes only, a stake 50 with first fin 51, second fin 52, third fin 53, and fourth fin 54 is depicted. First fin 51 and third fin 53 may reside in the same plane or in parallel planes. Similarly, second fin 52 and fourth fin 54 may reside in the same plane or in parallel planes. First fin 51 and second fin 52 may reside in perpendicular planes. In such embodiments, an axis A may be understood to be co-linear with the intersections of fins 51, 52, 53, and 54. In other embodiments, axis A may be understood to be co-linear with the longest length of the particular stake configuration being used. In the illustrated embodiment, stake 50 tapers from its upper end 501 to its lower end 502 so as to provide for easier effort in driving stake 50 into the earth.

In some embodiments, first fin 51 may include a first cutout 55, second fin 52 may include a second cutout 56, third fin 53 may include a third cutout 57, and fourth fin 54 may include a fourth cutout 58, to accommodate placement of tightening nut 382, as aforedescribed.

A stake plate 90 may be disposed proximate to upper end 501 of the mount, for example stake 50.

So configured, once the desired alignment of receptacle 30 to the mount, for example stake 50, is achieved as described in more detail hereinbelow, tightening bolt 381 may be tightened against tightening nut 382 to pull receptacle 30 toward stake 50 thereby to lock the adjustable post support into that desired alignment.

The structure providing means for adjusting the angular orientation of the longitudinal axis of a post receptacle relative to the longitudinal axis of a mount are an upper adjustment plate 70 and lower adjustment plate 80 disposed between receptacle 30 and the mount, for example stake 50.

Upper adjustment plate 70 may be rotated about an axis, for example the longitudinal axis B of receptacle 30. Upper adjustment plate 70 has a first surface 701 and a second surface 702, the first surface 701 being above second surface 702 and closer to receptacle 30. First surface 701 may be at least partially planar and the at least partial plane of first surface 701 may remain normal to the longitudinal axis B of receptacle 30 as upper adjustment plate 70 is rotated about longitudinal axis B of receptacle 30. Second surface 702 may be at least partially planar, the at least partial plane of second surface 702 may reside at an angle to and not parallel with the at least partial plane of first surface 701.

Lower adjustment plate 80 may be rotated about an axis, for example the longitudinal axis A of the mount such as stake 50. Lower adjustment plate 80 has what may be denominated to be a third surface 803 and a fourth surface 804, the fourth surface 804 being below the third surface 803 and closer to the mount. The fourth surface may be at least partially planar and the at least partial plane of the fourth surface may remain normal to the longitudinal axis A of the mount as the fourth adjustment plate is rotated about the longitudinal axis A of the mount. The third surface 803 may be at least partially planar, the at least partial plane of the third surface 803 may reside at an angle to and not parallel with the at least partial plane of the fourth surface 804.

The second surface 702 of the upper adjustment plate 70 may abut against the third surface 803 of the lower adjustment plate 80.

Thus, the upper and lower adjustment plates, 70 and 80 respectively, may be rotated relative to one another, and/or the upper adjustment plate 70 may be rotated relative to receptacle 30, and/or the lower adjustment plate 80 may be rotated relative to stake 50, such that the longitudinal axis B of receptacle 30 and the longitudinal axis A of the mount, such as stake 50, are parallel. Additionally, however, the upper and lower adjustment plates, 70 and 80 respectively, may be rotated relative to one another, and/or the upper adjustment plate 70 may be rotated relative to receptacle 30, and/or the lower adjustment plate 80 may be rotated relative to stake 50, such that the longitudinal axis B of receptacle 30 is caused to reside at an adjusted angle, for example C that is not 180 degrees, relative to the longitudinal axis A of the mount, for example stake 50. Considering that upper adjustment plate 70 may be rotated at any of three hundred sixty different degrees of orientation relative to the lower adjustment plate 80, and that lower plate 80 may be rotated at any of three hundred sixty different degrees of orientation relative to stake 50, adjusted angle C might be any of thousands of different orientations. It will be observed that rotating the upper adjustment plate 70 relative to the lower adjustment plate 80 will swing the longitudinal axis B of the receptacle in an arc. It will be further observed that rotating the lower adjustment plate 80 relative to the mount 50 may rotate such arc a full 360 degrees. Thus, by rotating both the lower adjustment plate 70 relative to the mount 50 and by rotating the upper adjustment plate 70 relative to the lower adjustment plate 80, the longitudinal axis of the receptacle B may be adjusted to an infinite number of angles relative to the longitudinal axis A of the mount.

Once upper adjustment plate 70 and lower adjustment plate 80 have been rotated relative to stake 50, receptacle 30, and/or to each other to a provide a desired adjusted angle C and axis B is perpendicular to the horizon (or resides at some other desired angle relative to the horizon), such desired adjusted angle C may then be locked by tightening bolt 381, which resides within receptacle plate aperture 94, tightener aperture 81, and stake plate aperture 95, with tightening nut 382.

Turning to the drawings, FIGS. 1, 2, 3, 4, 5, and 6 illustrate an embodiment of adjustable post support 20, including relative exemplary locations of the following components:

| | |
|---|---|
| stake axis A | fourth side 304 |
| receptacle axis B | first tab 31 |
| adjusted angle C | second tab 32 |
| lower plate angle D | third tab 33 |
| fold line G | fourth tab 34 |
| post support 20 | tightener apertures 39a, b, c, d |
| receptacle 30 | first bolt 351 |
| first side 301 | first nut 352 |
| second side 302 | second bolt 361 |
| third side 303 | second nut 362 |
| aperture 37 | first surface 701 |
| tightening bolt 381 | second surface 702 |
| tightening nut 382 | first tab 72 |
| stake 50 | lower adjustment plate 80 |
| upper end 501 | third surface 803 |
| lower end 502 | fourth surface 804 |
| first fin 51 | tightener aperture 81 |
| second fin 52 | second tab 82 |
| third fin 53 | stake plate 90 |
| fourth fin 54 | stake plate aperture 95 |
| first cutout 55 | receptacle plate 91 |
| second cutout 56 | receptacle plate aperture 94 |
| third cutout 57 | spacer 92 |
| fourth cutout 58 | spacer drains 93a, b |
| upper adjustment plate 70 | |

Figure 2:
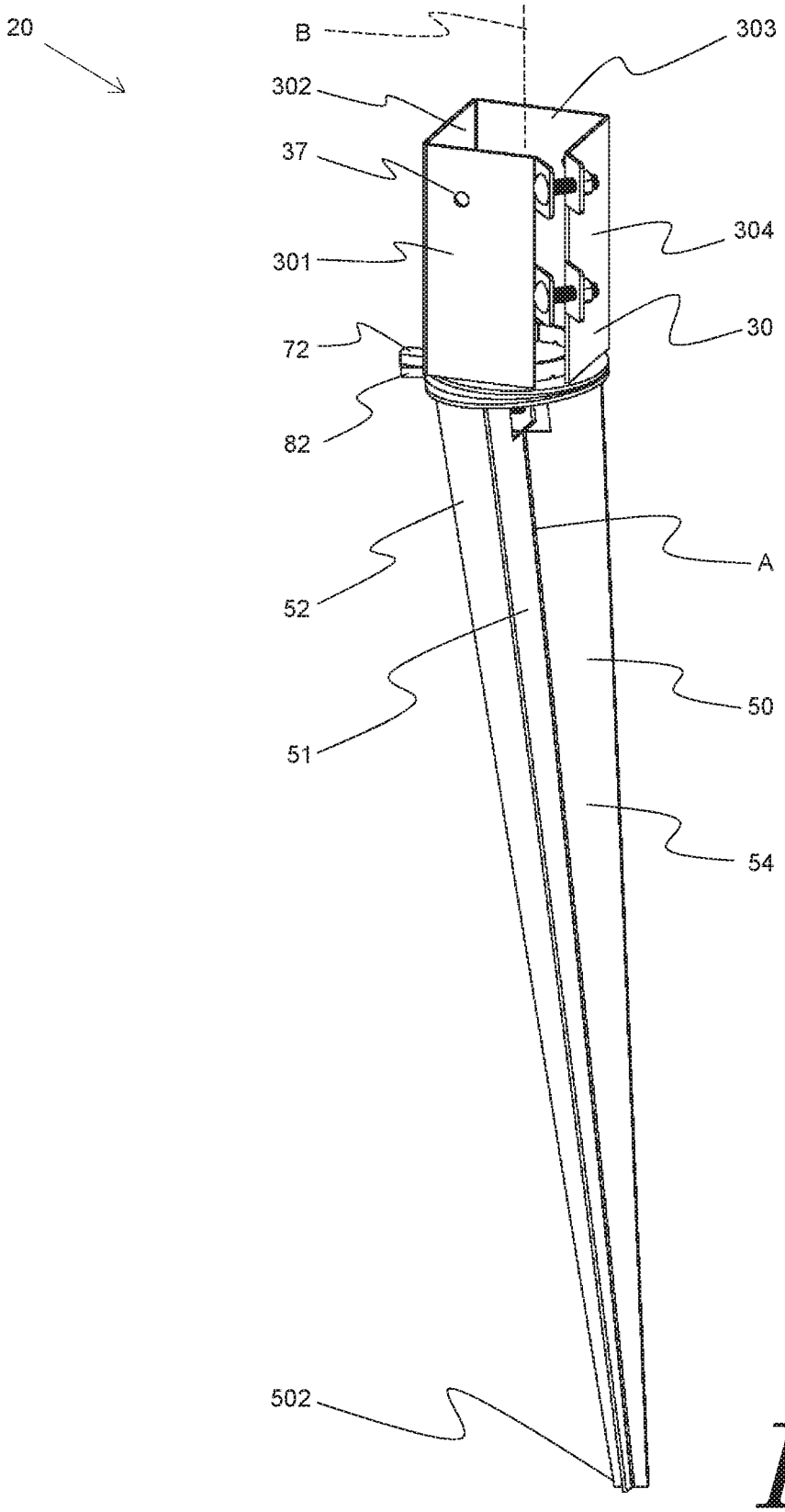
FIG. 2 is a perspective view of an adjustable post support in accordance with an embodiment of the present invention, wherein the longitudinal axis of the receptacle and the longitudinal axis of the mount are not parallel.

FIG. 1 illustrates a perspective view of an adjustable post support 20 in accordance with an embodiment of the present invention, wherein the longitudinal axis of the receptacle and the longitudinal axis of the mount are parallel. The relative positions of first tab 72 and second tab 82 will be observed. By comparison, FIG. 2 illustrates a perspective view of an adjustable post support 20 in accordance with an embodiment of the present invention, wherein the longitudinal axis of the receptacle and the longitudinal axis of the mount are not parallel—the relative positions of first tab 72 and second tab 82 has been changed from that of FIG. 1, in that upper adjustment plate 70 and lower adjustment plate 80 have been rotated to achieve adjusted angle C.

Figure 3:
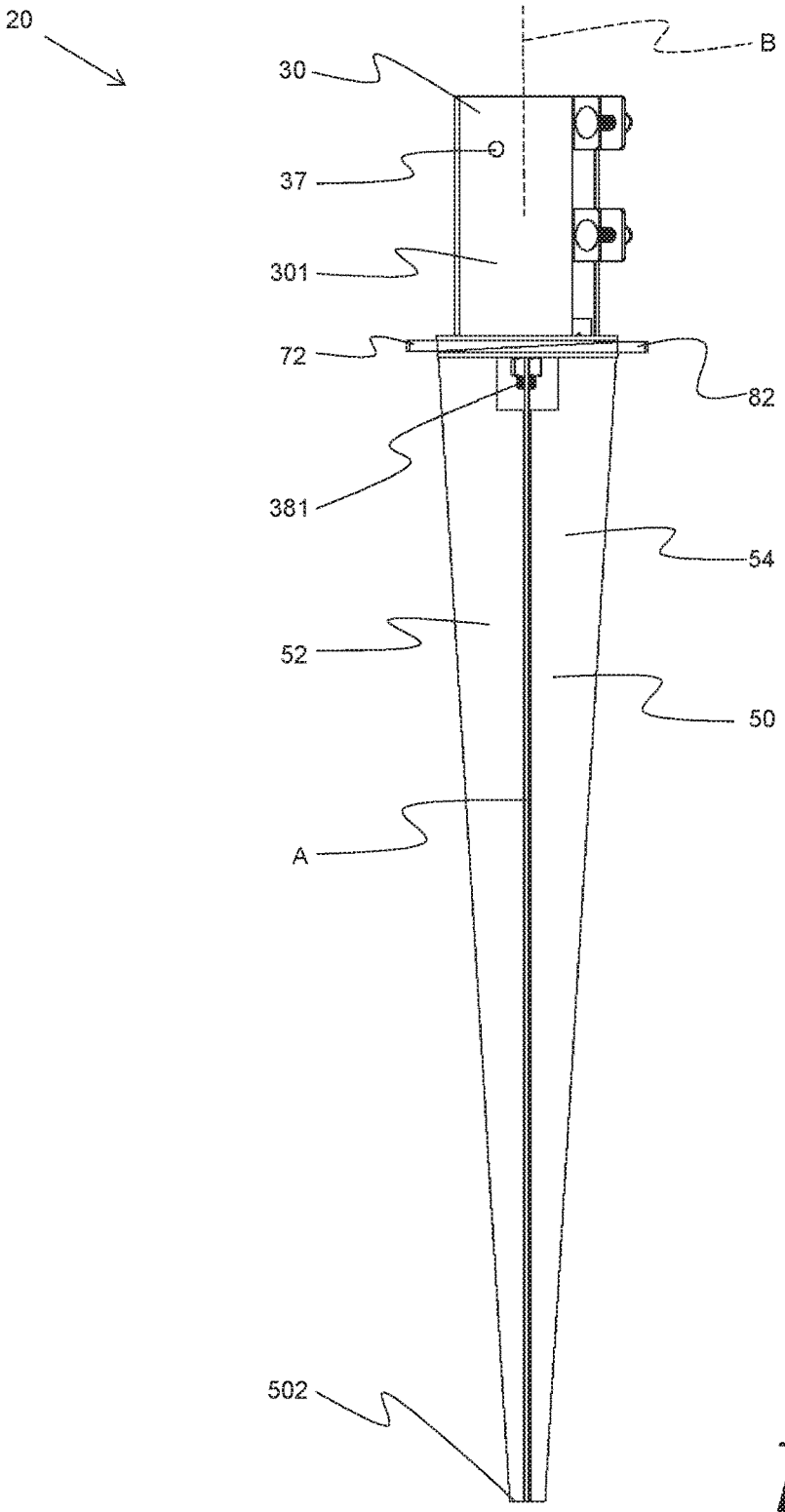
FIG. 3 is a side elevation of view of an adjustable post support in accordance with an embodiment of the present invention, wherein the longitudinal axis of the receptacle and the longitudinal axis of the mount are parallel.
Figure 4:
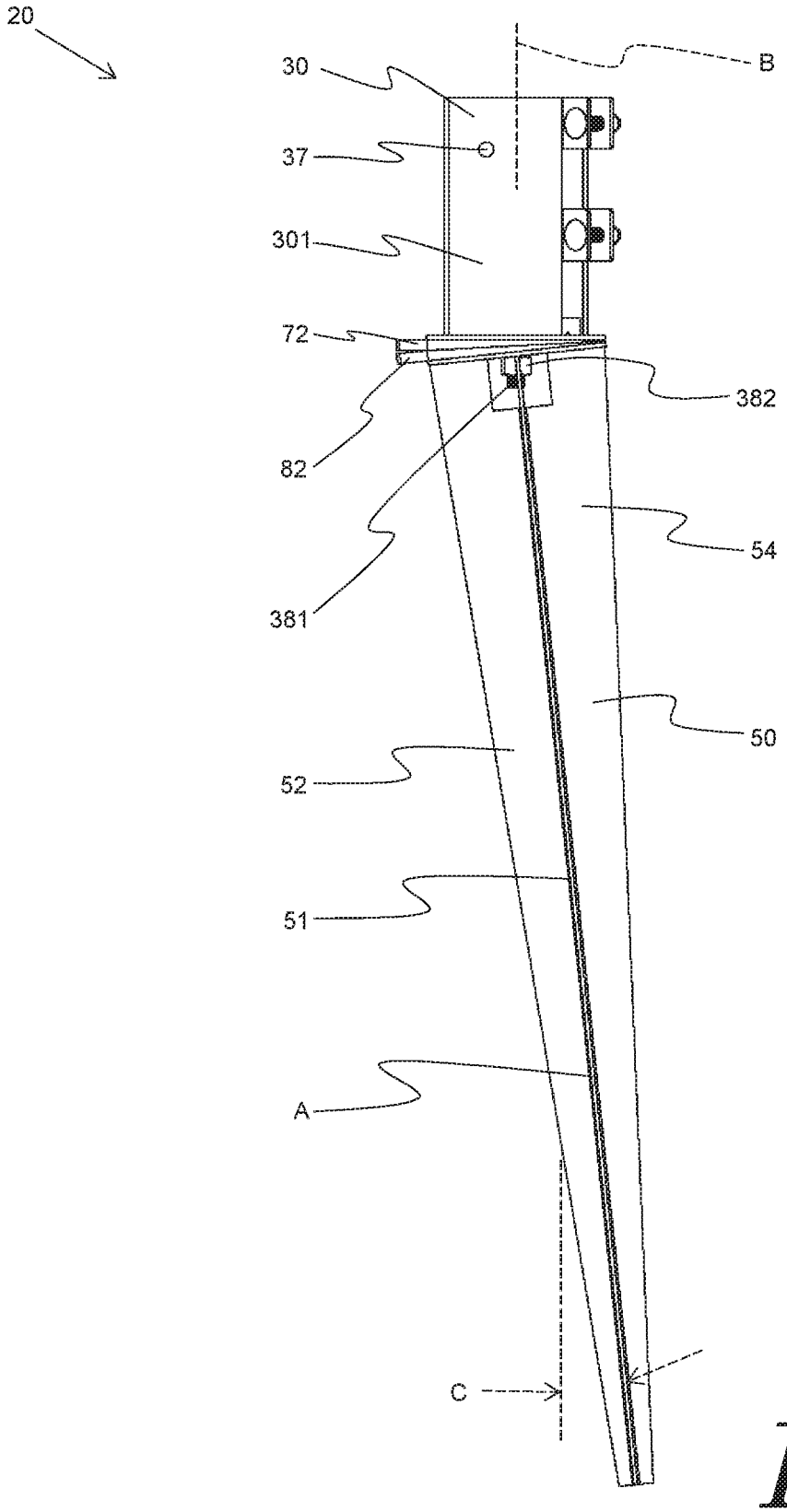
FIG. 4 is a side elevation of view of an adjustable post support in accordance with an embodiment of the present invention, wherein the longitudinal axis of the receptacle and the longitudinal axis of the mount are not parallel.

FIG. 3 illustrates a side elevation view of an adjustable post support 20 in accordance with an embodiment of the present invention, wherein the longitudinal axis of the receptacle and the longitudinal axis of the mount are parallel. The relative positions of first tab 72 and second tab 82 will be observed. By comparison, FIG. 4 illustrates a side elevation view of an adjustable post support 20 in accordance with an embodiment of the present invention, wherein the longitudinal axis of the receptacle and the longitudinal axis of the mount are not parallel—the relative positions of first tab 72 and second tab 82 has been changed from that of FIG. 3, in that upper adjustment plate 70 and lower adjustment plate 80 have been rotated to achieve adjusted angle C.

Figure 5:
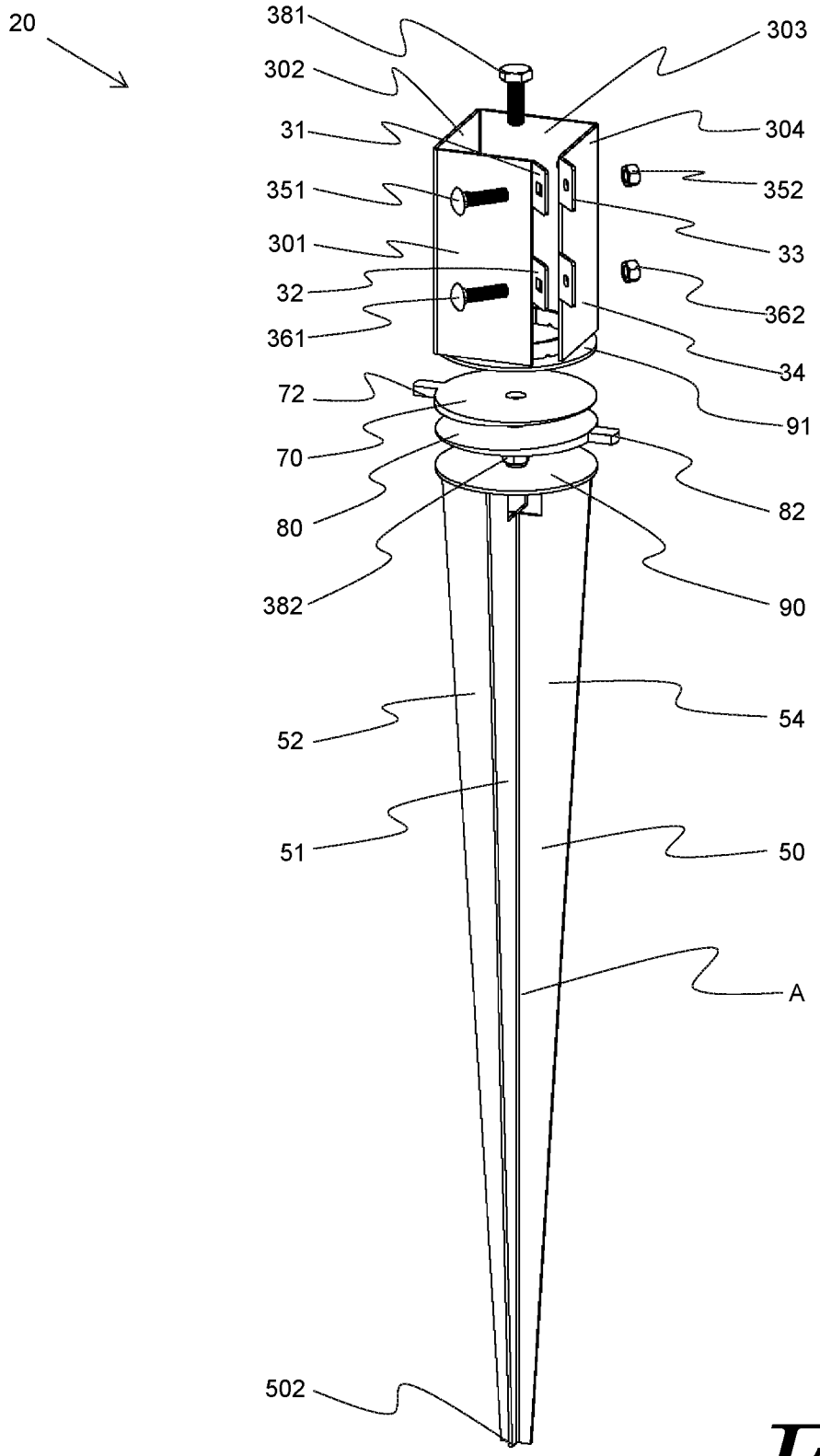
FIG. 5 is an exploded perspective view of an adjustable post support in accordance with an embodiment of the present invention.
Figure 6:
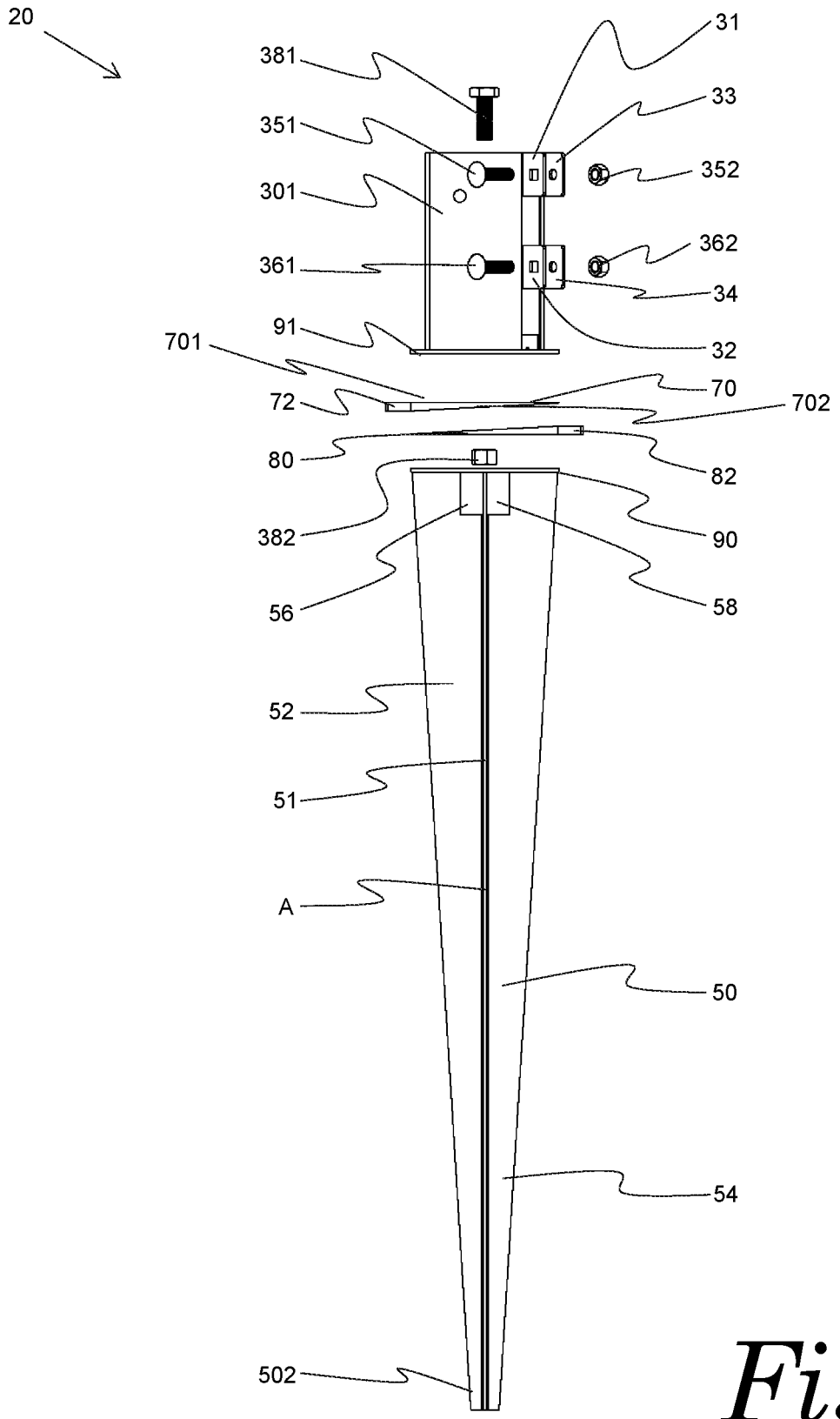
FIG. 6 is an exploded side elevation view of an adjustable post support in accordance with an embodiment of the present invention.

FIG. 5 illustrates an exploded perspective view of an adjustable post support 20 in accordance with an embodiment of the present invention, wherein the longitudinal axis of the receptacle and the longitudinal axis of the mount are parallel. The relative positions of first tab 72 and second tab 82 will be observed. By comparison, FIG. 6 illustrates an exploded side elevation view of an adjustable post support 20 in accordance with an embodiment of the present invention, wherein the longitudinal axis of the receptacle and the longitudinal axis of the mount are not parallel—the relative positions of first tab 72 and second tab 82 has been changed from that of FIG. 5, in that upper adjustment plate 70 and lower adjustment plate 80 have been rotated to achieve adjusted angle C.

Figure 7:
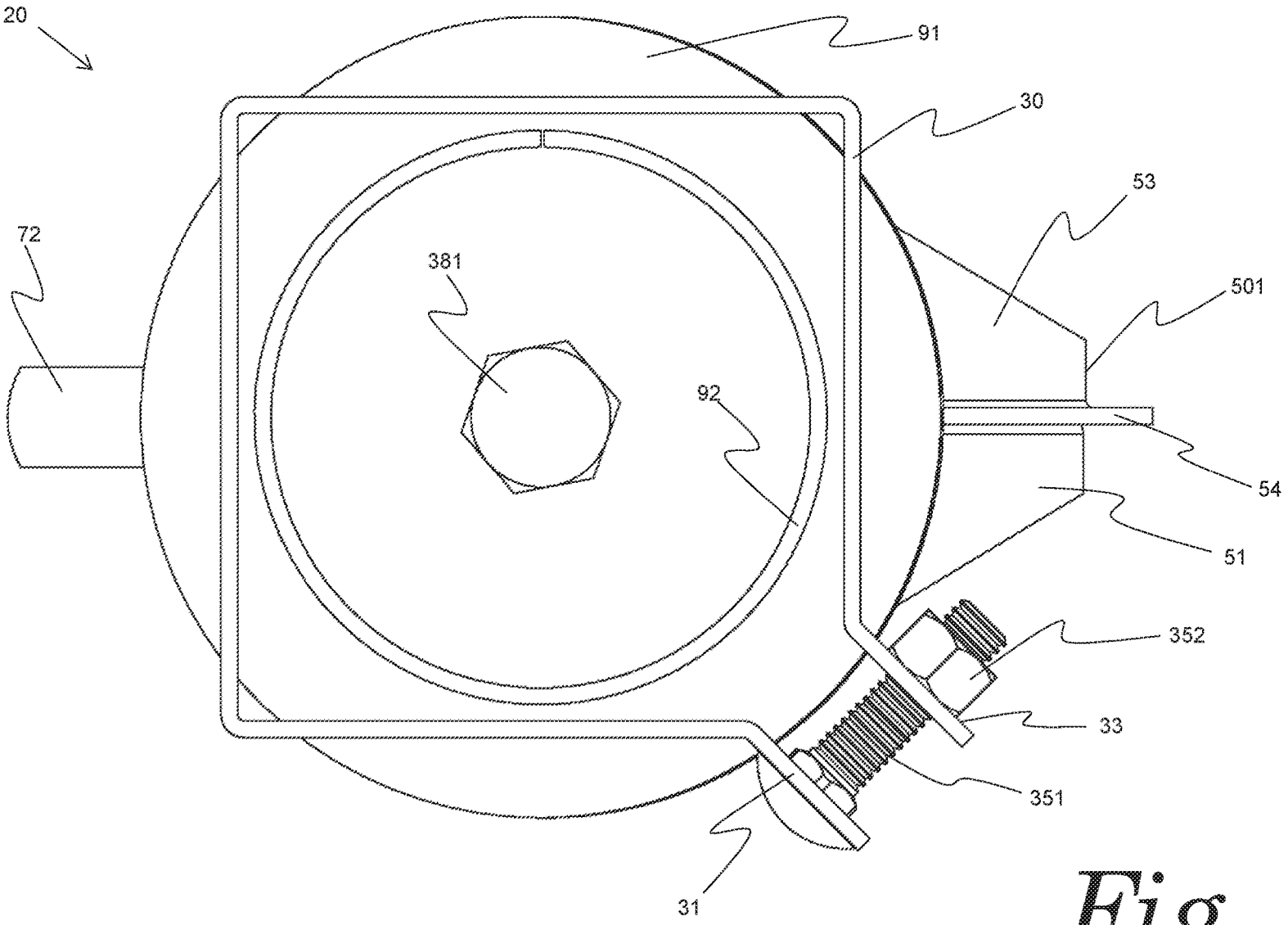
FIG. 7 is a top plan view of an adjustable post support in accordance with an embodiment of the present invention, wherein the longitudinal axis of the receptacle and the longitudinal axis of the mount are not parallel.
Figure 8:
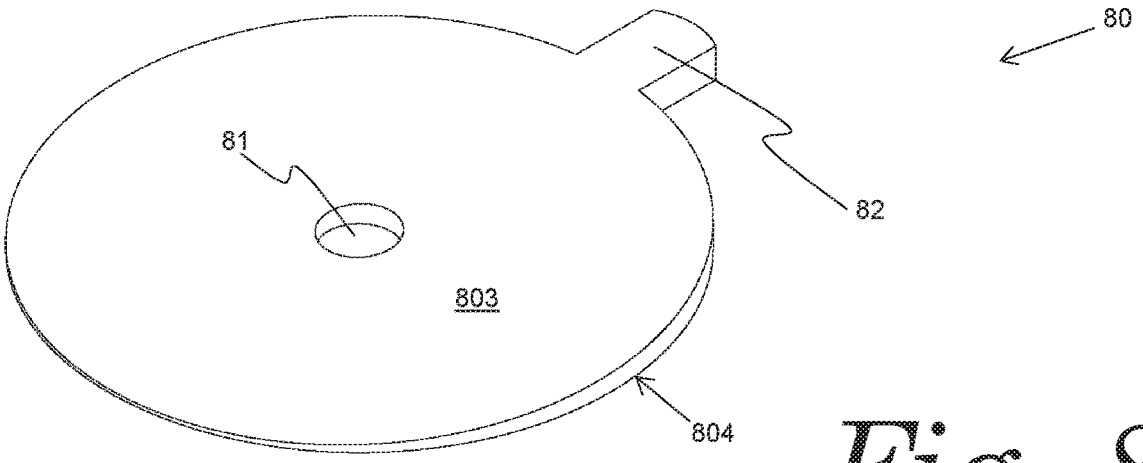
FIG. 8 is a perspective view of an adjustment plate in accordance with an embodiment of the present invention.
Figure 9:
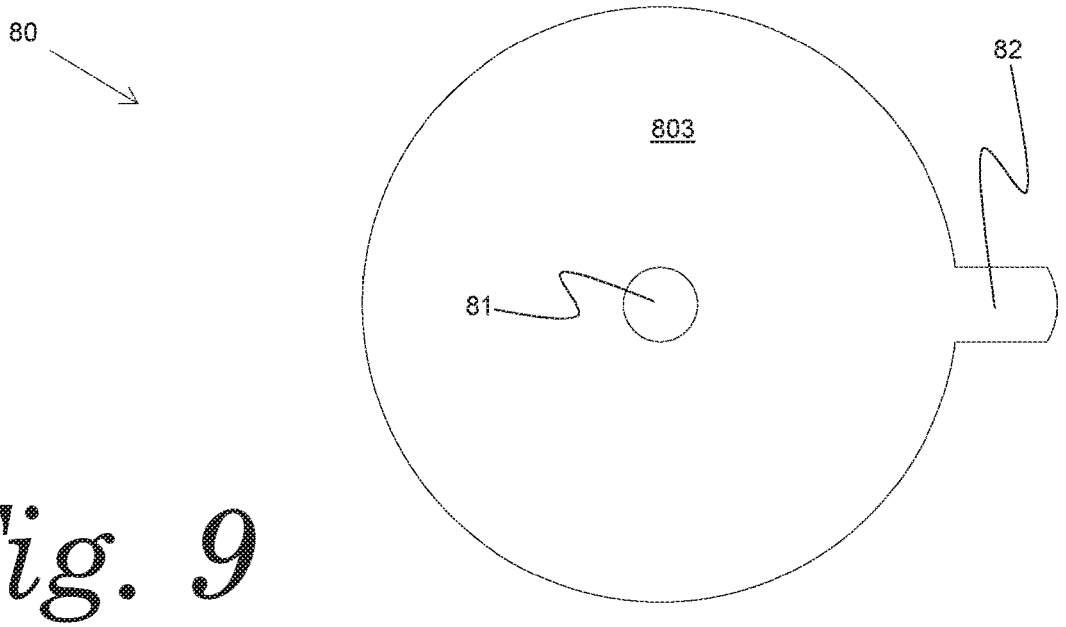
FIG. 9 is a top plan view of an adjustment plate in accordance with an embodiment of the present invention.

FIG. 7 illustrates a top plan view of an adjustable post support 20 in accordance with an embodiment of the present invention, wherein the longitudinal axis B of the receptacle, which extends normal to the illustration of FIG. 7, and the longitudinal axis A of the mount are not parallel, thus exposing to this view the lower end 501 of stake 50.

Figure 10:
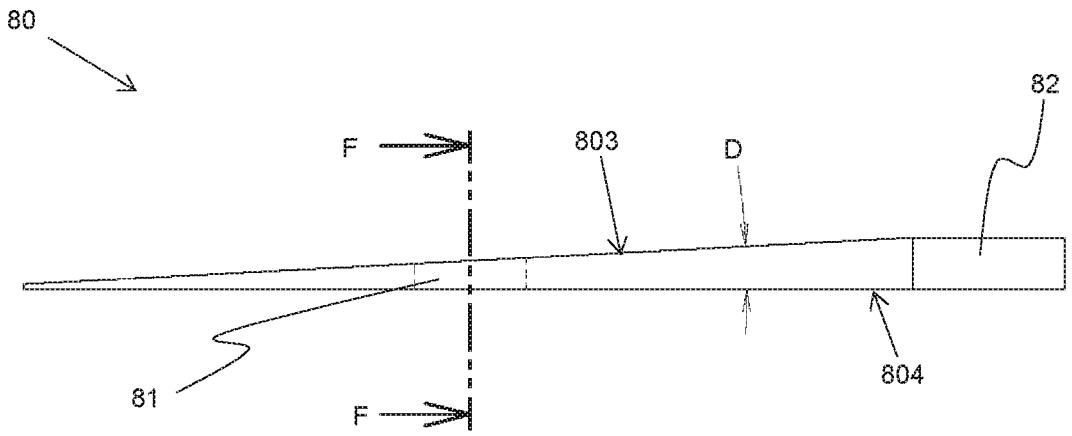
FIG. 10 is a side elevation view of an adjustment plate in accordance with an embodiment of the present invention.
Figure 11:
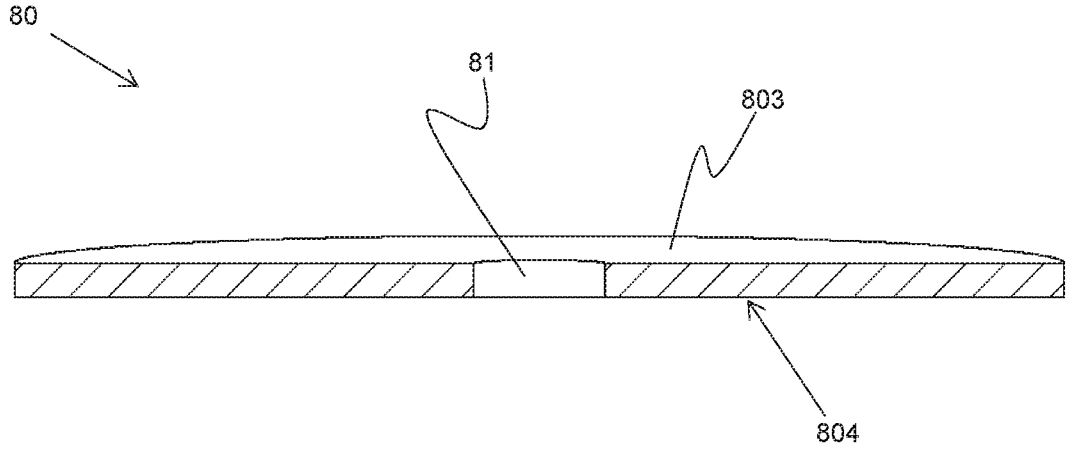
FIG. 11 is a cross-sectional view of an adjustment plate, taken at F:F in FIG. 10, in accordance with an embodiment of the present invention.

FIGS. 8, 9, 10, and 11 illustrate views of an example embodiment of lower adjustment plate 80, which includes tightener aperture 81 and tab 82. Upper adjustment plate 70 may be similarly, or exactly, configured, but is not depicted in the drawings. As illustrated in FIG. 10, lower adjustment plate 80 may have a third surface 803 and a fourth surface 804 that reside in different, nonparallel planes. Tightener aperture 81 is also illustrated. In some embodiments, lower plate angle D may be three degrees; in other embodiments, to achieve greater or lesser adjustability for adjustable post support 20, other lower plate angles D may be selected, along with different angles between first surface 701 and second surface 702 of upper adjustment plate 70.

Figure 12:
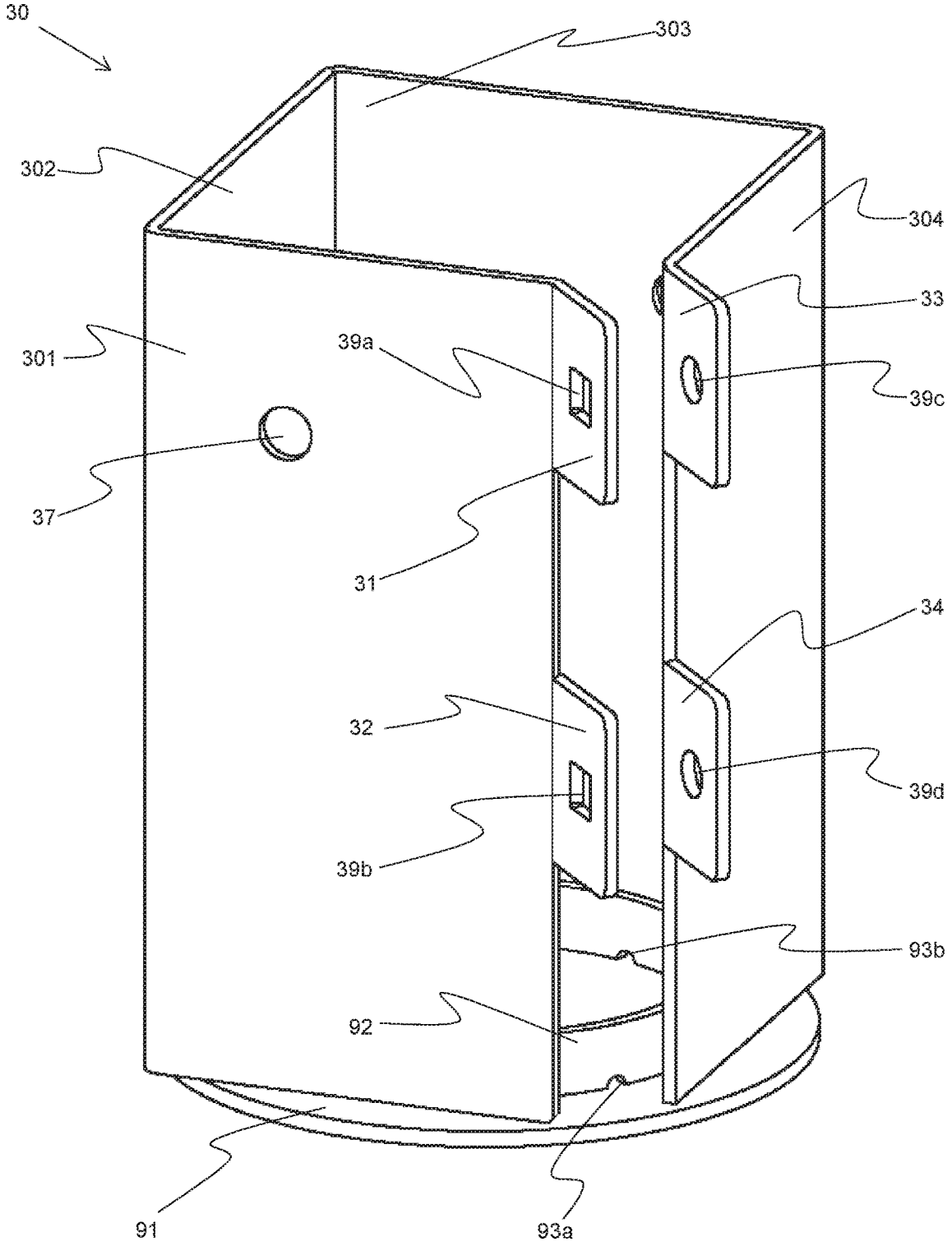
FIG. 12 is a perspective view of a receptacle in accordance with an embodiment of the present invention.
Figure 13:
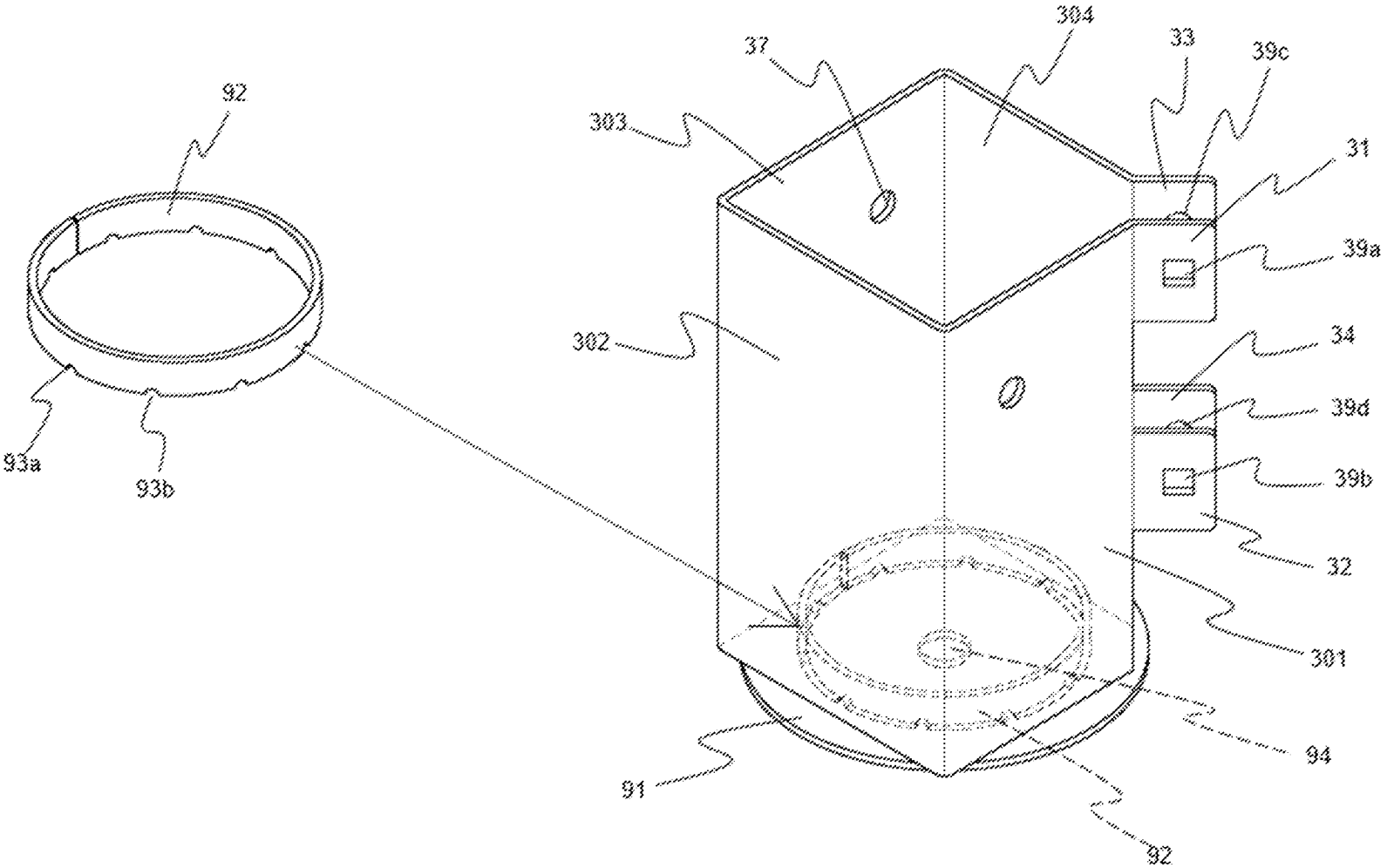
FIG. 13 is a diagrammatic view of a receptacle and a spacer in accordance with an embodiment of the present invention.
Figure 14:
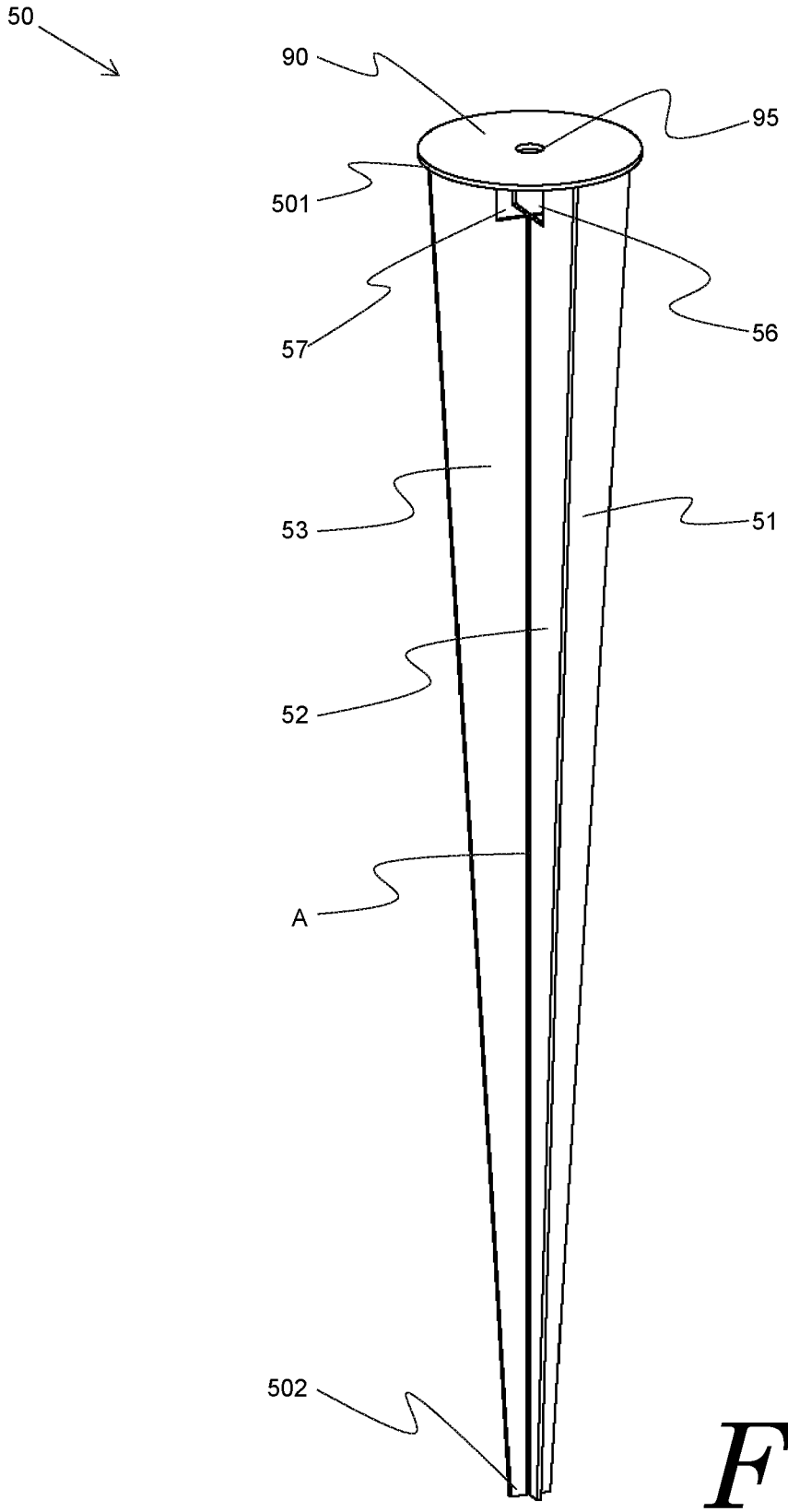
FIG. 14 is a perspective view of a mount in accordance with an embodiment of the present invention.
Figure 15:
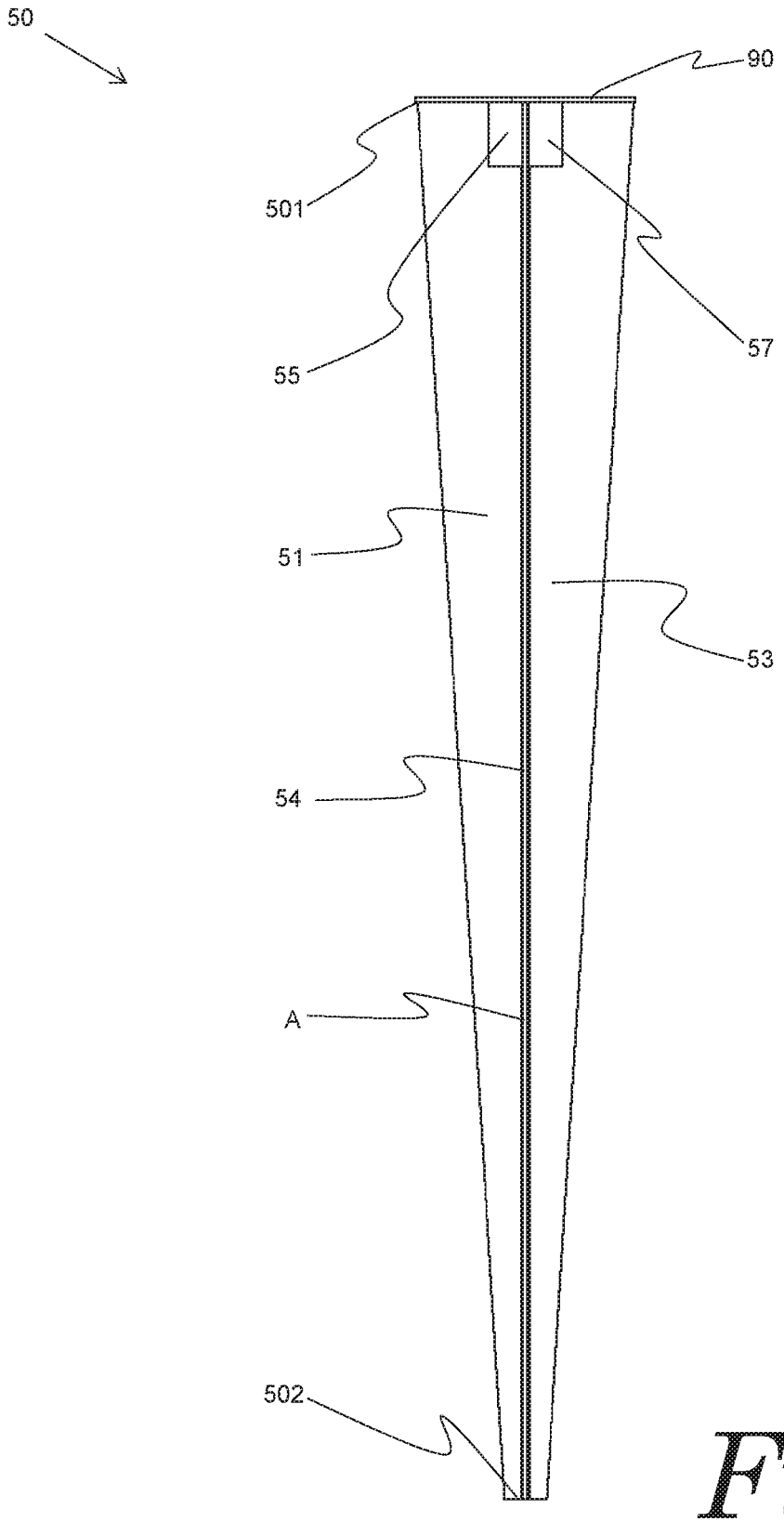
FIG. 15 is a side elevation view of a mount in accordance with an embodiment of the present invention.

FIGS. 12 and 13 illustrate examples of how receptacle 30 may be configured. As illustrated in both, a spacer 92 may be included that will provide space between a bottom of a post held by receptacle 30 and the bottom of receptacle 30, spacer 92 may to provide for drainage of rainwater and for aeration beneficial for wooden posts that may be received in receptacle 30.

Figure 16:
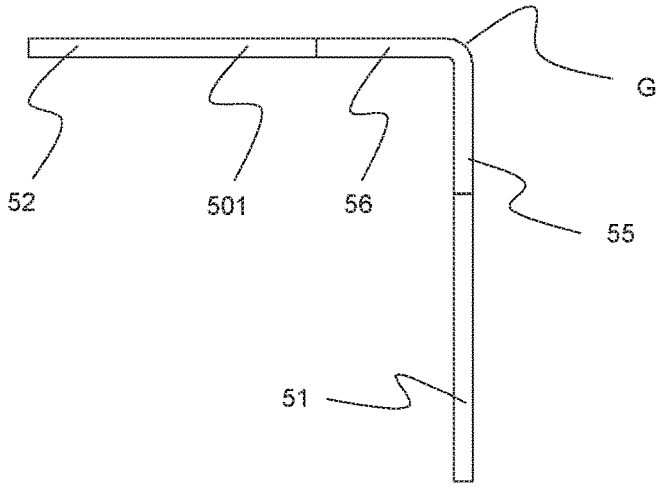
FIG. 16 is a top view of a portion of a mount in accordance with an embodiment of the present invention.
Figure 17:
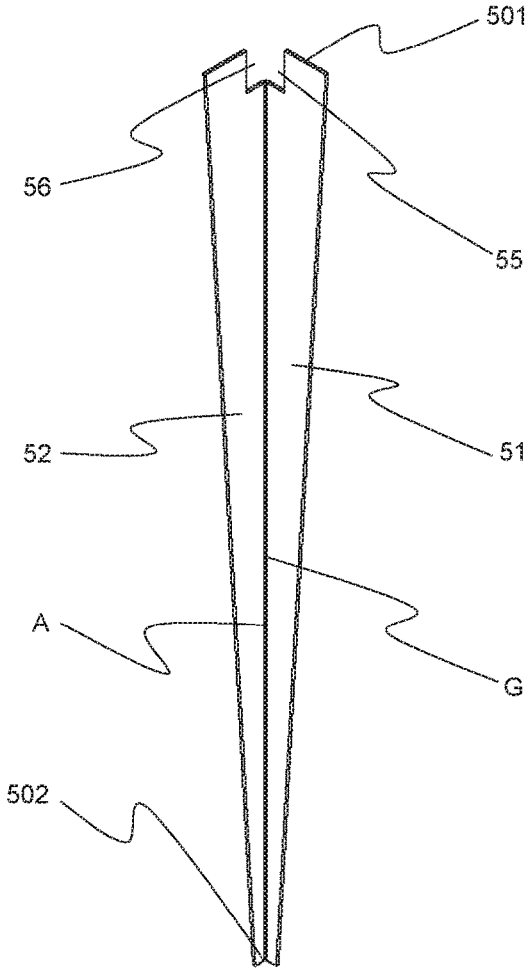
FIG. 17 is a perspective view of a portion of a mount in accordance with an embodiment of the present invention.

FIGS. 14, 15, 16, and 17 illustrate possible configurations of a stake 50 serving as a mount for adjustable post support 20. As illustrated in FIGS. 16 and 17, a stake 50 may be fabricated by bending or forming a single sheet of material at a ninety degree angle, creating fold lines G, then joining one such member with an identically-formed member at the fold lines G, so as to result in the configuration shown in FIG. 14. In such a configuration, fold line G would form stake axis A.

It should be appreciated that, in the above description of embodiments, various features are sometimes grouped together in a single embodiment, figure, or description for the purpose of streamlining the disclosure and aiding in the understanding of one or more of the various inventive aspects. This method of disclosure, however, is not be interpreted as reflecting an intention that any claim requires more features than are expressly recited in that claim. Moreover, any components, features, or steps illustrated and/or described in a particular embodiment herein, can be applied to or used with any other embodiment. Thus, it is intended that the scope of the inventions herein disclosed should not be limited by the particular embodiments described above, but should be determined only by a fair reading of the claims that may issue from the benefit of the within disclosure.

Further, the purpose of the Abstract is to enable the various patent offices and the public generally, and especially the scientists, engineers, and practitioners in the art who are not familiar with patent or legal terms or phraseology, to determine quickly from a cursory inspection the nature and essence of the technical disclosure of the application. The Abstract is not intended to be limiting as to the scope of the invention in any way.

The invention claimed is:

1. A post support, comprising:

a post receptacle, an upper adjustment plate, a lower adjustment plate, a stake, and a spacer;

the post receptacle:

defining a first longitudinal axis;

defining an open top;

including four sides that are parallel to the first longitudinal axis, the four sides having a first side, a second side, a third side, and a fourth side, the first side being joined with the second side, the second side being joined with the third side, the third side being joined with the fourth side, the fourth side and the first side not being joined, the fourth side and the first side defining a gap along the first longitudinal axis, the gap defining a gap width;

including means for reducing the gap width;

including a receptacle plate;

the upper adjustment plate:

residing below the receptacle plate;

being rotatable about the first longitudinal axis relative to the post receptacle;

having a first surface and an opposing second surface, the first surface and the second surface not being parallel to each other;

the lower adjustment plate:

residing below the upper adjustment plate;

being rotatable about a longitudinal axis of the stake relative to the stake;

having a third surface and an opposing fourth surface, the third surface and the fourth surface not being parallel to each other, the third surface being disposed against the second surface;

the stake:

extending below the lower adjustment plate;

including a first fin and a second fin, each of the first fin and the second fin having a cutout, the first fin and the second fin converging to form a V-shaped member;

the spacer:

residing at a bottom of the post receptacle;

including spacer drains.

2. The post support of claim 1, wherein the means for reducing the gap width include outboard tabs.

3. The post support of claim 1, wherein the upper adjustment plate further includes a tab residing outboard of the upper adjustment plate.

4. The post support of claim 1, wherein the receptacle plate is disposed at the bottom of the post receptacle.

5. The post support of claim 1, wherein the stake further includes a third fin and a fourth fin; wherein the first fin and the third fin reside in a first plane; and wherein the second fin and the fourth fin reside in a second plane.

6. The post support of claim 1, wherein the upper adjustment plate and the lower adjustment plate are round.

7. A method of adjusting an angular orientation of a post relative to a horizontal plane, comprising the steps of:

providing the post support of claim 1;

driving the stake into a ground;

rotating one or both of the upper adjustment plate and the lower adjustment plate until a desired angular orientation of the post receptacle is achieved; and installing the post in the post receptacle.

8. A post support, comprising:

a post receptacle, an upper adjustment plate, a lower adjustment plate, a stake, and a spacer;

the post receptacle:

defining a first longitudinal axis;

defining an open top;

including four sides that are parallel to the first longitudinal axis, the four sides having a first side, a second side, a third side, and a fourth side, the first side being joined with the second side, the second side being joined with the third side, the third side being joined with the fourth side, the fourth side and the first side not being joined, an outer edge of the fourth side and an outer edge of the first side being opposite to each other and defining a gap along the first longitudinal axis;

including a first tab, a second tab, a third tab, and a fourth tab, the first tab and the second tab residing along the outer edge of the first side, the third tab and the fourth tab residing along the outer edge of the fourth side;

including a receptacle plate;

the upper adjustment plate:

residing below the receptacle plate;

being rotatable about the first longitudinal axis relative to the post receptacle;

having a first surface and an opposing second surface, the first surface and the second surface not being parallel to each other;

the lower adjustment plate:

residing below the upper adjustment plate;

being rotatable about a longitudinal axis of the stake relative to the stake;

having a third surface and an opposing fourth surface, the third surface and the fourth surface not being parallel to each other, the third surface being disposed against the second surface;

the stake:

extending below the lower adjustment plate;

tapering from wider to narrower along a length of the stake from top to bottom;

including a first fin and a second fin, each of the first fin and the second fin having a cutout, the first fin and the second fin converging to form a V-shaped member;

the spacer:

residing at a bottom of the post receptacle;

including spacer drains.

9. The post support of claim 8, wherein the upper adjustment plate further includes a fifth tab residing outboard of the upper adjustment plate.

10. The post support of claim 8, wherein the receptacle plate is disposed at the bottom of the post receptacle.

11. The post support of claim 8, wherein the stake further includes a third fin and a fourth fin; wherein the first fin and the third fin reside in a first plane; and wherein the second fin and the fourth fin reside in a second plane.

12. A post support, comprising:

a post receptacle, an upper adjustment plate, a lower adjustment plate, a stake, and a spacer;

the post receptacle:

defining a first longitudinal axis;

defining a substantially rectangular cross-section orthogonal to the first longitudinal axis;

having four planar sides that are parallel to the first longitudinal axis, the four planar sides having a first planar side, a second planar side, a third planar side, and a fourth planar side, each of the first planar side, the second planar side, the third planar side, and the fourth planar side having a first edge and an opposing second edge, the second edge of the first side being joined with the first edge of the second side, the second edge of the second side being joined with the first edge of the third side, the second edge of the third side being joined with the first edge of the fourth side, the second edge of the fourth side not being joined with the first edge of the first side;

having a first tab, a second tab, a third tab, and a fourth tab, the first edge of the first side carrying the first tab and the second tab, the second edge of the fourth side carrying the third tab and the fourth tab, the third tab and the fourth tab being adjacent to the first tab and the second tab, respectively;

having a receptacle plate disposed at a bottom of the post receptable;

the upper adjustment plate:

residing below the receptacle plate;

being rotatable about the first longitudinal axis relative to the post receptacle;

having a first surface and an opposing second surface, the first surface being above the second surface and disposed closer to the post receptacle;

the first surface having at least one planar portion, the at least one planar portion of the first surface remaining perpendicular to the first longitudinal axis as the upper adjustment plate is rotated about the first longitudinal axis relative to the post receptacle;

the second surface having at least one planar portion, the at least one planar portion of the second surface residing at an angle relative to and not parallel with the at least one planar portion of the first surface;

the lower adjustment plate:

residing below the upper adjustment plate;

being rotatable about a longitudinal axis of the stake relative to the stake;

having a third surface and an opposing fourth surface, the fourth surface being below the third surface;

the fourth surface having at least one planar portion, the at least one planar portion of the fourth surface remaining perpendicular to the longitudinal axis of the stake as the lower adjustment plate is rotated about the longitudinal axis of the stake relative to the stake;

the third surface having at least one planar portion, the at least one planar portion of the third surface residing at an angle relative to and not parallel with the at least one planar portion of the fourth surface, the third surface being disposed against the second surface;

the stake:

being attached to the post receptacle below the lower adjustment plate;

having a stake plate;

tapering from wider to narrower along a length of the stake from top to bottom;

including a first fin and a second fin, each of the first fin and the second fin having a cutout, the first fin and the second fin converging to form a V-shaped member;

the spacer:

residing at the bottom of the post receptacle;

including spacer drains.

13. The post support of claim 12, wherein the upper adjustment plate further includes a fifth tab residing outboard of the upper adjustment plate.

14. The post support of claim 12, wherein the stake further includes a third fin and a fourth fin; wherein the first fin and the third fin reside in a first plane; and wherein the second fin and the fourth fin reside in a second plane.

* * * * *